US012022933B2

(12) United States Patent
Grund et al.

(10) Patent No.: US 12,022,933 B2
(45) Date of Patent: Jul. 2, 2024

(54) MAKEUP SYSTEM

(71) Applicant: And.B, LLC, New York, NY (US)

(72) Inventors: Bobbie Lynn Grund, New York, NY (US); Andrea DeVos Abraham, New York, NY (US)

(73) Assignee: Woosh Beauty, LLC, New York, NY (US)

( * ) Notice: Subject to any disclaimer, the term of this patent is extended or adjusted under 35 U.S.C. 154(b) by 645 days.

(21) Appl. No.: 15/331,246

(22) Filed: Oct. 21, 2016

(65) Prior Publication Data

US 2017/0112261 A1 Apr. 27, 2017

Related U.S. Application Data

(60) Provisional application No. 62/244,360, filed on Oct. 21, 2015.

(51) Int. Cl.

| | |
|---|---|
| ***A45D 40/24*** | (2006.01) |
| ***A45D 40/22*** | (2006.01) |
| ***A45D 42/02*** | (2006.01) |

(52) U.S. Cl.

CPC ..... *A45D 40/24* (2013.01); *A45D 40/222* (2013.01); *A45D 42/02* (2013.01); *A45D 2040/224* (2013.01)

(58) Field of Classification Search

CPC ..... A45D 40/24; A45D 40/222; A45D 42/02; A45D 2040/224; A45D 2200/05; A45D 2200/25; A45D 33/006; A45D 33/008; A45D 33/24; A45D 33/003; A45D 33/38

USPC ..... 132/295; 206/581, 823, 235

See application file for complete search history.

(56) References Cited

U.S. PATENT DOCUMENTS

| | | | | |
|---|---|---|---|---|
| 1,290,671 A * | 1/1919 | Sherwood | ..... | A45D 33/006 132/301 |
| 1,460,509 A * | 7/1923 | Wilson | ..... | A45D 33/006 132/296 |
| 1,465,548 A * | 8/1923 | Foster | ..... | A45D 33/006 132/293 |
| 1,506,589 A * | 8/1924 | Jaroslawski-Fioret | ..... | A45D 33/006 132/296 |
| 1,534,497 A * | 4/1925 | Boorman | ..... | A45D 33/006 132/297 |

(Continued)

FOREIGN PATENT DOCUMENTS

GB 473593 A * 10/1937

OTHER PUBLICATIONS https://web.archive.org/web/20141107170412/http://makeupandbeauty.com/bh-cosmetics-malibu-eyeshadow-and-blush-palette-review/, Nov. 3, 2014 (Year: 2014).*

*Primary Examiner* — Rachel R Steitz
*Assistant Examiner* — Brianne E Kalach
(74) *Attorney, Agent, or Firm* — WARNER NORCROSS + JUDD LLP

(57) ABSTRACT

A makeup system includes a first carrier for holding a first palette of makeup and a second carrier for holding a second palette of makeup. The first carrier is joined with the second carrier and joined in a manner to allow the two carriers to be folded together. The system further includes a third carrier joined with the first carrier or the second carrier. The third carrier includes a support for supporting a sheet, which sheet can include a guide on how to apply the makeup that is included in the first and/or second palettes.

12 Claims, 5 Drawing Sheets

(56) References Cited

U.S. PATENT DOCUMENTS 1,601,892 A * 10/1926 Thralls ..... A45D 33/26
132/296
1,622,463 A * 3/1927 Marcus ..... A45D 33/006
132/296
1,715,820 A * 6/1929 Deitel ..... A45D 33/006
132/294
1,754,981 A * 4/1930 Coryell ..... A45D 33/006
132/296
1,790,586 A * 1/1931 Leshin ..... A45D 33/006
132/296
2,061,139 A * 11/1936 Cohen ..... B65D 73/0035
206/534
2,784,757 A * 3/1957 Bosca ..... A45C 13/1069
150/138
4,500,169 A * 2/1985 Donnelly ..... A45D 42/00
434/371
4,890,872 A * 1/1990 Parrotta ..... G09F 23/10
206/823
6,554,001 B1 * 4/2003 Godshaw ..... A45D 33/008
132/312
6,640,813 B2 * 11/2003 Raisner ..... A45C 11/008
132/200
9,480,322 B2 * 11/2016 Mortis Simons .... A45D 33/008
2003/0172949 A1 * 9/2003 Alexander ..... A45D 33/006
132/303
2004/0003825 A1 * 1/2004 Kelly ..... A45D 33/22
132/301
2006/0027481 A1 * 2/2006 Gelardi ..... G11B 33/0444
132/294
2006/0042992 A1 * 3/2006 Vulcano ..... A45C 5/03
206/581
2010/0051049 A1 * 3/2010 Jaworski ..... A45D 40/24
132/296
2010/0132734 A1 * 6/2010 Mills ..... A45D 40/24
132/294
2011/0061675 A1 * 3/2011 McKinley ..... A45D 33/20
132/296
2018/0116367 A1 * 5/2018 Matsuura ..... A45D 40/22

* cited by examiner

MAKEUP SYSTEM

This application claims the benefit of U.S. Provisional Patent Application No. 62/244,360, filed on Oct. 21, 2015, which is incorporated herein by reference in its entirety.

TECHNICAL FIELD AND BACKGROUND OF THE INVENTION

The present invention generally relates to a makeup system that helps the user apply makeup.

Makeup application can be an art. It requires careful application. To achieve the best results, a user needs to know where to apply the makeup. Often the sequence can be important to achieve a specific look, as well as to minimize mistakes. In addition, following a sequence may allow a user to save time.

SUMMARY OF THE INVENTION

Accordingly, a makeup system is disclosed that can help even the uninitiated makeup user apply makeup in a way to achieve a professional look.

In one embodiment, a makeup system includes a first carrier for holding a first palette of makeup and a second carrier for holding a second palette of makeup. The first carrier is joined with the second carrier and joined in a manner to allow the two carriers to be folded together. The system further includes a third carrier joined with the first carrier or the second carrier. The third carrier includes a support for supporting a sheet, which sheet can include a guide on how to apply the makeup that is included in the first and/or second palettes or photos or other visual images to provide inspiration.

In one aspect, the guide may also or alternatively provide instruction on how to use makeup tools that could also be included in the makeup system.

In one aspect, the third carrier is joined with the first carrier or the second carrier in a manner to allow the three carriers to be folded together so that the foot print of the system is no greater than the largest carrier.

In another aspect, the first and second carriers each have a first side on which the respective makeup palette is mounted and a second side opposed from the first side. Optionally, the first makeup palette and/or the second makeup palette are mounted flush or recessed into the respective first side of the respective carrier so that when the first and second carriers are folded they have a total thickness of approximately equal to the total of the thicknesses of the two carriers.

Optionally, the third carrier may be folded in between the first and second carriers so that when all three carriers are folded they have a total thickness of approximately equal to the total of the thicknesses of the three carriers.

In one aspect, the support comprises a pocket mounted to or formed with the third carrier. For example, the pocket may comprise a transparent pocket so that when the sheet is placed in the pocket it is visible through the pocket.

In another aspect, each carrier is formed from a panel and, optionally, first and second panels that are joined to together. Further, when formed from two panels, the first panels form the first side of the respective carrier and the second panels form the second sides of the carriers. Optionally, the second panels are joined together by a hinge, such as a living hinge to join the two carriers together.

In one aspect, the third carrier is hinged, for example, by a living hinge to the top edge of the first carrier, and optionally in between the first and second panels of the first carrier.

In addition, the first carrier may include a closure mechanism, for example in the form of a flexible strip mounted to the side edge of the first carrier, which includes a releasable fastener (or at least one half of a fastener) for securing the carriers in a folded configuration. For example, the fastener may include a hook or loop strip that couples to a corresponding loop or hook strip provided on the outside of the second carrier. Alternately, the fastener may comprise a snap or magnet that couples to a corresponding engagement structure or magnetic metal strip provided on the second carrier, for example, on the outside of the second carrier.

Optionally, the makeup palette is formed from a plurality of discrete makeup pans that are individually mounted to the respective carriers. Optionally, the makeup pans may be re-fillable pans. In addition, the makeup pans are arranged on or in the carriers in an order in which the makeup can be applied. Further, the makeup pans may be separated a distance sufficient to allow labeling and/or indicia to further provide a guide for applying the makeup.

Before the embodiments are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE PREFERRED EMBODIMENTS

Figure 1:
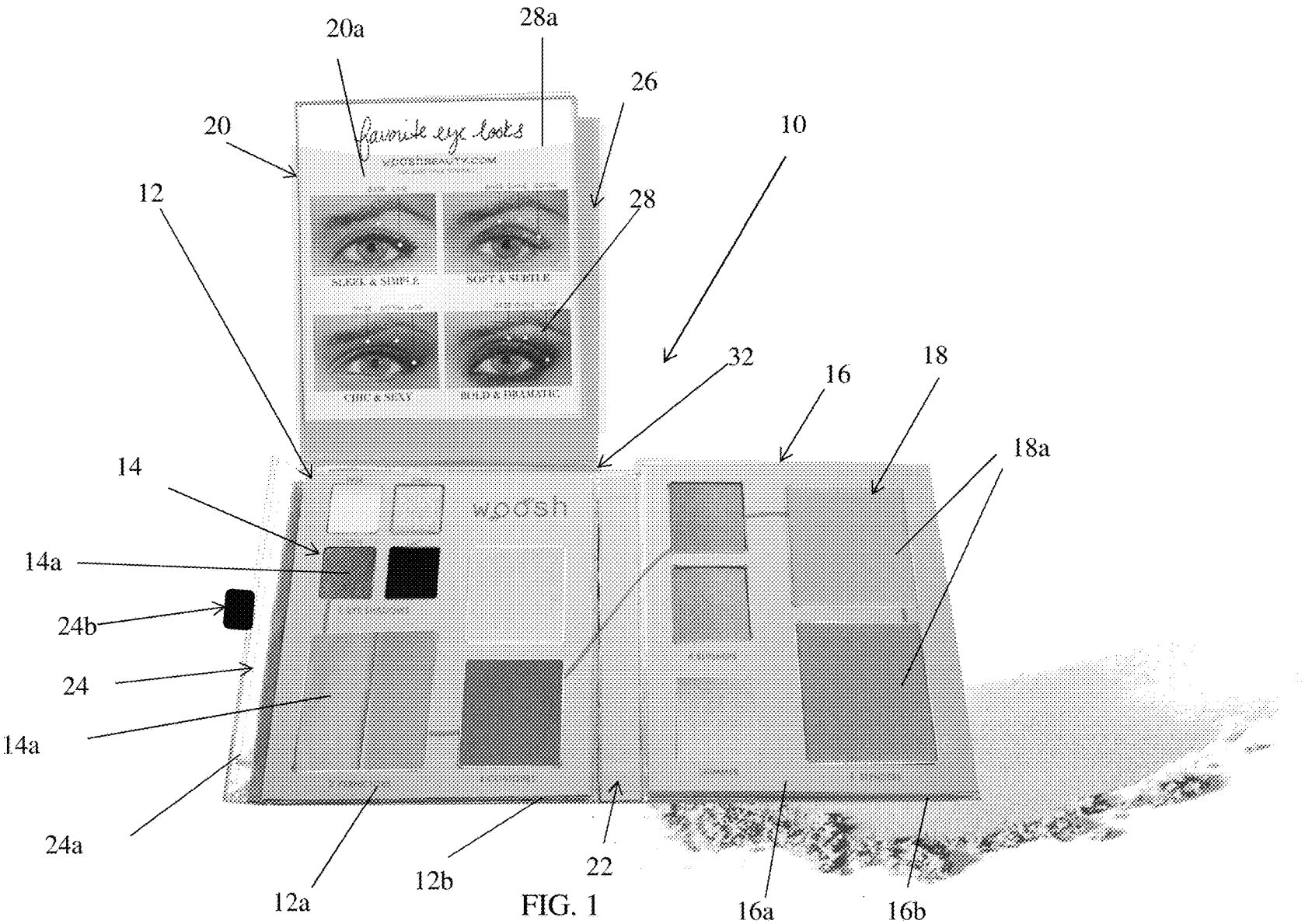
FIG. 1 is a front perspective view of a makeup system shown in an unfolded configuration.
Figure 2:
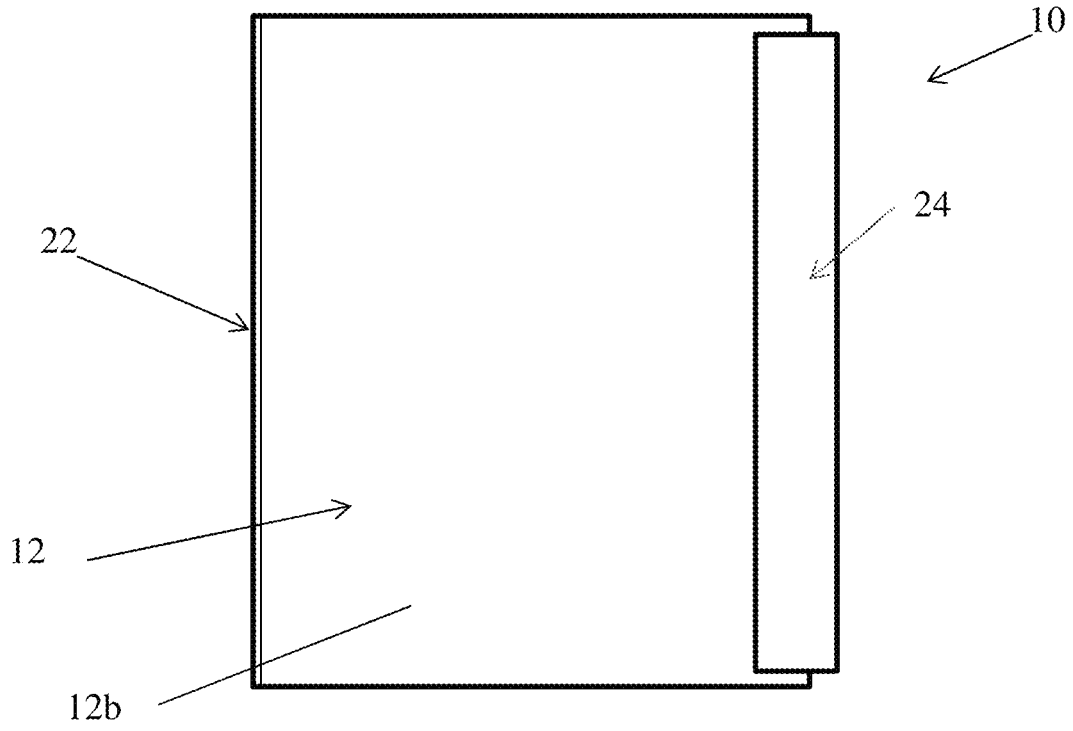
FIG. 2 is a similar view to FIG. 1 but with the makeup system shown in a folded configuration.

Referring to FIG. 1, the numeral 10 generally designates a makeup system. As will be more fully described below, makeup system 10 is configured to provide an assortment of makeup options along with a guide that can help a user apply makeup in a way to achieve a professional look.

As best seen in FIG. 1, makeup system 10 includes a first carrier 12 for holding a first palette of makeup 14 and a second carrier 16 for holding a second palette of makeup 18. As understood from FIG. 1, the term palette refers to a group of makeup cakes supported in pans. The makeup pans 14*a* may be commonly mounted as a group on a piece of cardboard that is fitted in the carrier or may be individually mounted, as will be more fully described below. Additionally, the makeup pans may be removably mounted as a group or in groups or individually so that they may be replaced (so that palette can be refilled) when they are used up or simply to customize or personalize the selection of makeup. Further, some of the makeup pans may be permanently attached, while others may be removable. For example, system 10 may be assembled with a base color palette but then have one or more receptacles for receiving a person's customized makeup pans or group of makeup pans. If the base color palette is then used up, the customized makeup pans or group of makeup pans can be removed and placed in a new makeup system.

Additionally, the system may include a support 20, which is described below, for holding a guide so that a user can consult the guide while applying the makeup.

Optionally, the first carrier 12 is joined with the second carrier 16 in a manner to allow the two carriers to be folded together. For example, the first carrier 12 may be joined with the second carrier 16 by a hinge 22, such as a living hinge, for example, formed from one or more plastic strips of material, which are either attached to carriers 12 and 16 or formed by the carriers themselves, for example.

Additionally, the system 10 may include a closure mechanism 24. For example closure mechanism 24 may be in the form of a foldable strip or flange 24*a* formed or mounted to the side edge of the first carrier, which includes a releasable fastener (or at least one half of a fastener) for securing the carriers in a folded configuration. For example, the releasable fastener may include a hook or loop strip that couples to a corresponding loop or hook strip provided on the second carrier, such as the outside edge of the second carrier. Alternately, the fastener may comprise a snap or magnet that couples to a corresponding engagement structure or magnetic metal strip provided on the second carrier, such as the outside edge of the second carrier. Further, the closure mechanism 24 may be in the form of loop, such as elastic loop that can extend around the carriers when they are folded together.

In addition, strip 24*a* may include a pull 24*b* to facilitate decoupling the strip from the second palette to unfold and open the makeup system. Pull 24*b* may be formed from a piece of fabric or plastic that is joined to the strip, such as by an adhesive or by a weld (when the strip and pull are made of materials than can be heat sealed or welded together).

In another embodiment, pull 24*b* may be formed from an elastic loop. The loop may be sufficiently large and/or elastic so that it can be used to loop around the folded carriers to thereby add a securement mechanism to assure that the system 10 will stay folded or closed, which may be desirable when putting system 10 in a purse or luggage.

Alternately, the loop that forms pull 24*b* may be sized so that it can hold a makeup applicator or tool, such as a tube of lip stick, a tube of mascara, a brush, or other cylindrical or elongated makeup applicators or tools to thereby secure the makeup applicator or tool to the exterior of the folded carriers.

Further, a separate elastic loop with multiple looped portions may be used to loop around the folded carriers to thereby secure the carriers in their folded configuration, with the looped portions providing locations for holding multiple cylindrical or elongated makeup applicators or tools. For example, the elastic loop may be formed from two elastic strips that are joined together at spaced locations, for example, by stitching, to thereby form the multiple looped portions along the length of the elastic loop.

As noted above, system 10 includes a support 20 for holding a sheet. Optionally, the sheet may comprise a card, which includes a guide on how to apply the makeup that is included in the first and/or second palettes supported by the carriers or photos or other images that may provide inspiration. System 10 optionally includes a third carrier 26 joined with the first carrier or the second carrier. The third carrier may provide a mount for or form support 20 for supporting the sheet. For example, the sheet may be formed from a card, such as laminated card, which includes either written instructions and/or visual instructions on how to apply the makeup or simply include photos or other images noted above. Furthermore, the card may be formed from a material that allows notes to be made on the card, for example, tips that the user may want to record on the card. For example, the card may be formed from or covered with a layer that will accept a certain ink or other writing medium. Optionally, the guide may also or alternatively provide instruction on how to use makeup tools that could also be included in the makeup system.

For example, third carrier 26 may be joined with the first carrier or the second carrier in a manner to allow the three carriers to be folded together. Therefore, system 10 may also include a second hinge 28, such as a living hinge, for example, formed from one or more plastic strips of flexible material, which are attached to the third carrier 26 and to carrier 12 or carrier 16, for example, by an adhesive or weld or the like.

Optionally, at least carriers 12 and 16 are the same size. Carrier 26 may be the same size or slightly smaller than either carrier 12 or 16 so that when all three carriers are folded, the footprint of the system is no greater than the largest carrier, and carrier 26 is within the footprint of carriers 12 and 16. The term "footprint" as used herein refers to the outermost perimeter.

As best seen in FIG. 1, first and second carriers 12, 16 each have a first side 12*a*, 16*a* on which the respective makeup palette 14, 18 is mounted and a second side 12*b*, 16*b* opposed from the first side. Optionally, the first makeup palette and/or the second makeup palette is mounted flush or recessed into the respective first side of the respective carrier so that when the first and second carriers are folded they have a total thickness of approximately equal to the total of the thicknesses of the two carriers. Therefore, the thickness of each carrier is either approximately equal to or slightly greater than the thickness of the thickest makeup pan in the makeup palettes. In this manner, system 10 can maintain a slim profile for easy handling and storing in, for example, a handbag.

Optionally, as noted, the third carrier 26 may folded in between the first and second carriers so that when all three carriers are folded they have a total thickness of approximately equal to the total of the thicknesses of the three carriers.

As noted above, third carrier 26 either supports or forms support 20. In the illustrated embodiment, support 20 comprises a pocket 28 formed with or on the third carrier 26. For example, pocket 28 may comprise a transparent generally rectangular sheet that is attached along three sides to the carrier 26 with the one side unattached to form the pocket so that when the guide sheet is placed in the pocket, the guide sheet is visible through the pocket (at least as viewed when unfolded as shown in FIG. 1). For example, pocket 28 may be formed by a transparent plastic sheet 20*a* that is mounted to carrier 26 along three of its edges, such as by an adhesive or by molding, heat sealing or welding, so that together the plastic sheet 20*a* and carrier 26 form the pocket. Alternately, the pocket may be formed by two sheets joined together along three of their sides, which are then mounted to the carrier, such as by an adhesive or by molding, heat sealing or welding, or by a releasable fastener, such as described above.

Figure 3:
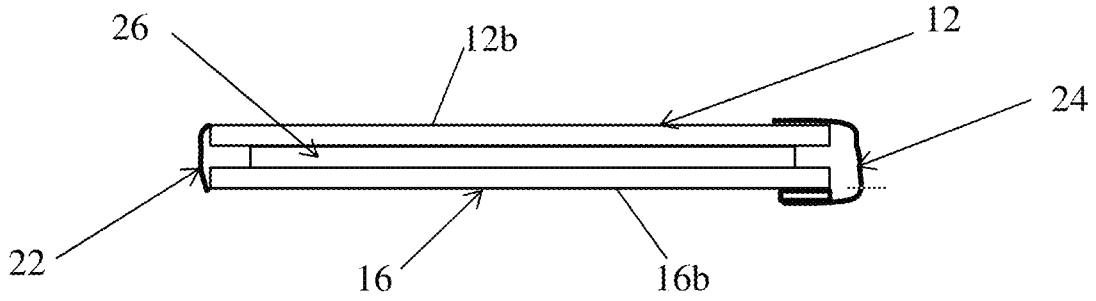
FIG. 3 is an end view of the makeup system shown in a folded configuration.
Figure 4:
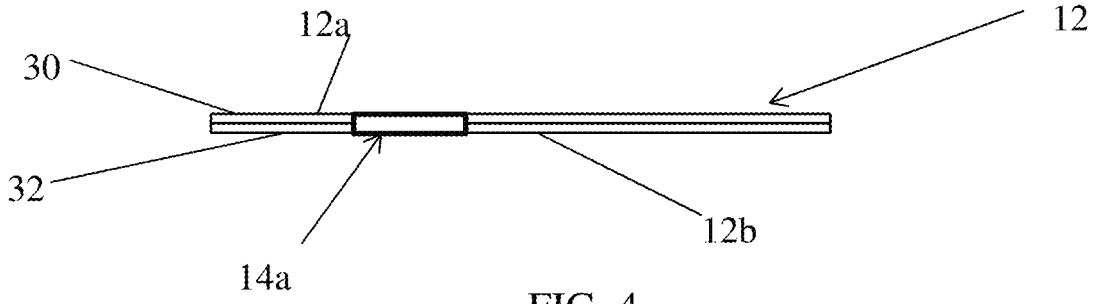
FIG. 4 is an exemplary cross-section of a portion of one of the carriers.

Carriers 12, 16, and 26 may be each formed from panels. For example, each carrier may be formed from a single panel 30 or first and second panels 30, 32 that are joined to together, for example, by an adhesive. Further, when formed from two or more panels, the first panels 30 may form or be located at the first side 12*a*, 16*a*, 26*a* of the respective carrier and the second panels 32 may form or be located at the second or outer sides 12*b*, 16*b*, and 26*b* of the carriers. Optionally, as best understood from FIGS. 3 and 4, the second panels 32 forming the first and second carriers 12, 16 are joined together by a hinge, such as a living hinge, to join the two carriers together.

For example, the panels may be formed from a variety of materials, including a paper product, such as paper board or cardboard, or from a plastic or a metal, such as aluminum. Further, each panel may be covered by a coating, a film, or a cover to provide the desired aesthetic appearance. Additionally, the second side of at least the first and second carriers may be covered with a different material or have a different color or finish than the first side of each carrier. Optionally, the first sides or second sides may have pockets formed thereon for holding labels or the like or may have regions of material that will accept ink or other writing mediums to allow a user to personalize their system.

Optionally, the outer surfaces of the carriers may be customized. For example, system 10 may include covers or stickers that allow a person to customize the color and/or add patterns or images on the outer surfaces of the carriers.

Third carrier 26 may also be joined to the first or second carrier by a hinge. In the illustrated embodiment, carrier 26 is joined by a hinge 32, such as living hinge, to the top edge of the first carrier, and optionally in between the first and second panels of the first carrier (see FIG. 3).

In addition, optionally, as noted, each makeup palette may be formed from a plurality of discrete makeup pans 14*a*, 18*a* that are individually mounted to the respective carriers, either by an adhesive or the like, or by press fitting the pans into a receptacle formed or provided on the inner facing side of the respective carrier. The receptacle may be simply an opening that is the same size as the pans so that when the pans are inserted they are held in place by friction between the carrier and the pan. Or the pans may be mounted by magnets mounted in the receptacle (or the magnets may be on the pans and the receptacle may have a carbon-based metal plate mounted therein). In addition, the makeup pans 14*a*, 18*a* may be arranged on or in the carriers in an order in which the makeup can be applied. Further, the makeup pans 14*a*, 18*a* may be separated a distance sufficient to allow labeling and/or indicia to further provide a guide for applying the makeup, as noted above.

Alternately, as noted above, some or all the makeup pans may be mounted to a cardboard (or plastic) panel that can be inserted into the respective panel or between the two panels forming the carrier. For example, as noted above, each carrier may be formed from a paper board, such as paper board or cardboard, or from a plastic or a metal, such as aluminum. Additionally, when formed from a paper board, the board may be folded over to leave the lower edge of the carrier open for insertion of the palette into the respective panel. When fully inserted the makeup pans will align with the respective openings formed on inside facing side of the carrier.

Further, each panel of the carrier may be covered by a coating, a film, or a cover to provide the desired aesthetic appearance. Additionally, the second side of at least the first and second carriers may be covered with a different material or have a different color or finish than the first side of each carrier. Optionally, the first sides or second sides may have pockets formed thereon for holding labels or the like or may have regions of material that will accept ink or other writing mediums to allow a user to personalize their system.

Furthermore, as noted above the carriers may be adapted so they can be reconfigured to allow selective removal of one or more makeup pans 14*a*, 18*a* so that they can be replaced with different colors or type of makeup. Optionally, the makeup pans may be re-fillable makeup pans. For example, a sheet of magnet material may be provided in the construction of the respective carriers. It should be understood that that the both the pans and the carriers may carry magnets or that the carriers can have magnets while the pans include a carbon-based metal sheet in their construction. Other type of fasteners, such as mechanical fasteners or reusable adhesives or Velcro-patches, may be used to detachably associate the pans with the carriers. For example, the opposing surfaces of the pans and the carrier may include corresponding hook and loop fasteners or corresponding pairs of snaps or snap fit elements.

In one embodiment, each carrier may be formed with a relatively rigid plate, such as a plastic or metal plate, that is slidably mounted, for example, in the panels that form the carrier. The plate is configured to mechanically engage each pan to thereby hold the pans in the carrier. When the plate is moved, e.g. pushed or pulled, the plate disengages from each pan so that the carrier need simply be tilted or flipped over and all the pans can be released from the carrier together, leaving recesses or wells in the carrier for receiving new pans of makeup. When the recesses are then filled with new pans, the plate may be returned to its engaged position. Optionally, the plate may disengage only from selected pans or disengage from one group of pans when moved in one direction and disengage from another group of pans when moved in another direction.

In yet another embodiment, one or both carriers 12,16 may include an additional carrier that is hinged, for example, along its edge to the "base" carrier so that one or both carriers 12, 16 may each comprise a bi-fold carrier so that when unfolded, system 10 has three or four adjacent carriers. Optionally, each carrier may have a makeup palette to increase the user's selection of makeup. Further, these additional carriers may be removable mounted to their respective "base" carrier so that the system may be expanded and then contracted as needed.

In any of the above, one of the carriers may include or form a mirror. For example, the mirror may replace pocket 20 or be provided on a fourth carrier. Further yet, the mirror may be mounted to the back of the third carrier by a hinge so that it can be flipped or pivoted between a stowed position behind the pocket and an operative position where it overlies the pocket. In a further embodiment, the carrier holding the mirror may have a kick stand, which can be moved from stowed position to an operative position where it supports the carrier on which the mirror is mounted. Thus, the third carrier may have a pocket formed on the inside of panel (or between its two panels) and a mirror mounted to the outside of the panel, and a deployable kickstand between the mirror and the panel so that after the mirror is pivoted to its operative position over the pocket, the kick stand can be deployed.

Figure 5:
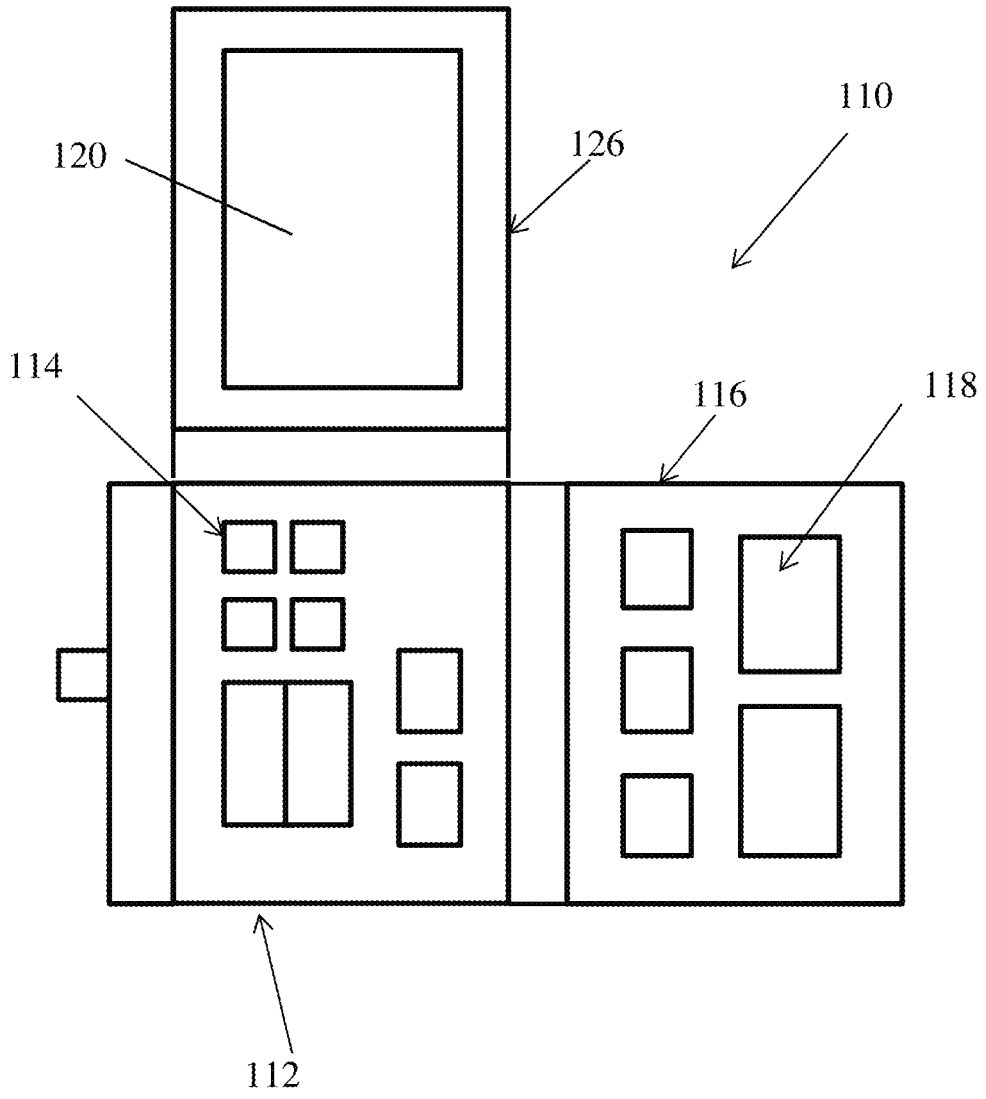
FIG. 5 is a perspective view of another embodiment of a makeup system shown in an unfolded configuration.

Referring to FIG. 5, the numeral 110 designates another embodiment of the makeup system. Similar to makeup system 10, makeup system 110 includes a first carrier 112 which supports a first palette of makeup 114, a second carrier 116 for holding a second palette of makeup 118, and a third carrier 126. For further details of the construction of the carriers, palettes, and how the carriers are joined together and folded and closed, and any other details, reference is made to the description above.

In the illustrated embodiment, makeup system 110 includes a mirror 120 in lieu of support 20. Mirror 120 may be surface mounted (e.g. using an adhesive or releasable fasteners) to carrier 126 or may be mounted in a pocket formed on carrier, with the pocket having an open window through which the mirror can be seen. Further, the pocket may retain the mirror on carrier 126 but allow the mirror to be removed, for example through an opening at the upper edge of the pocket. Alternately, the pocket may be sealed on all four sides during the manufacturing process (after the mirror is located in the pocket) so that the mirror is captured in the pocket and cannot be removed without destroying the pocket.

Figure 6:
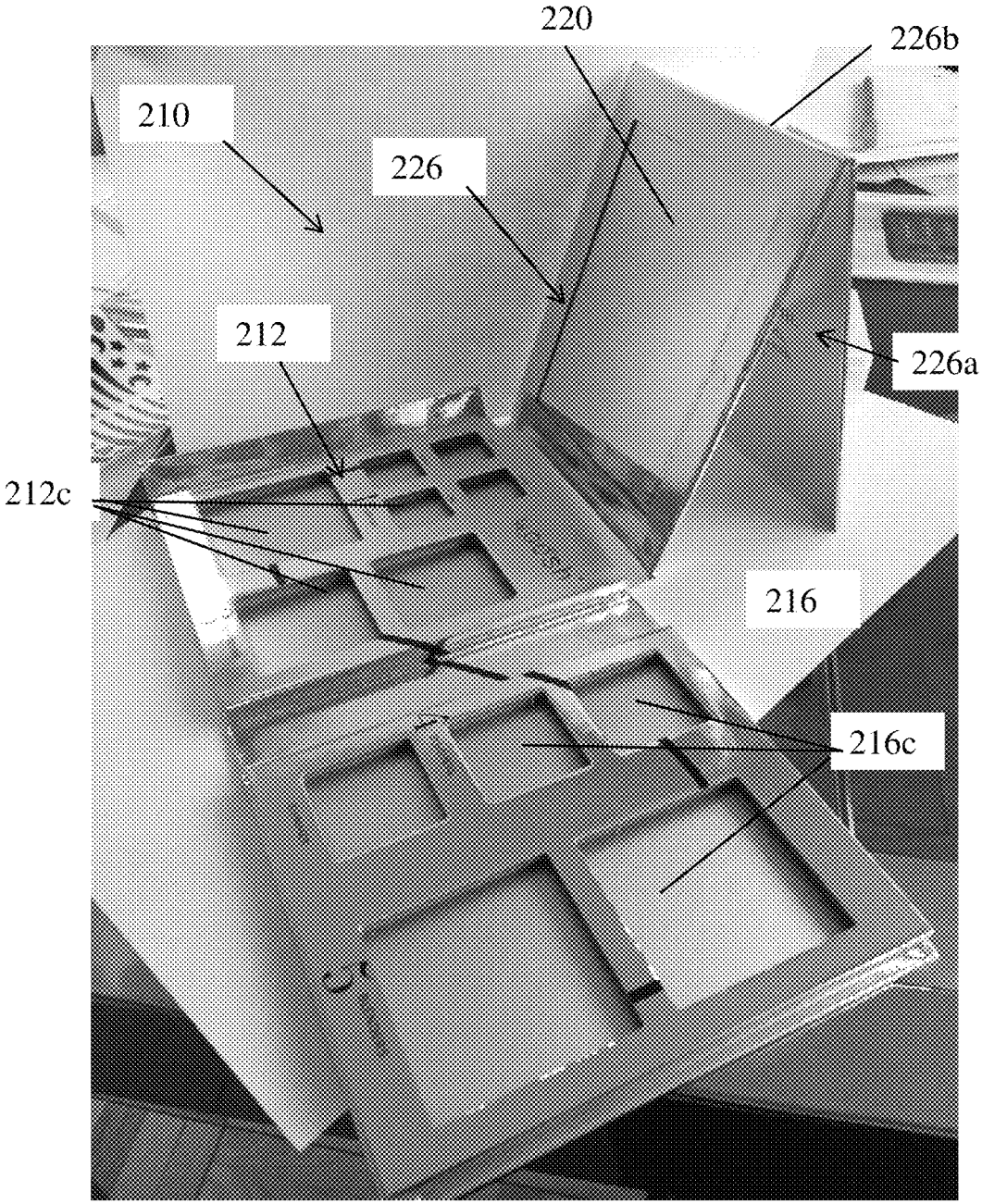
FIG. 6 perspective view of a third embodiment of a makeup system.

In yet another embodiment, as noted above, the third carrier may have a support for the mirror, for example, in the form of a kick stand. Referring to FIG. 6, the numeral 210 designates another embodiment of the makeup system. Similar to makeup systems 10 and 110, makeup system 210 includes a first carrier 212 that includes a plurality of openings or recesses 212*c* for holding makeup pans to form a first palette of makeup, a second carrier 216 with a plurality of openings or recesses 216*c* for holding makeup pans for forming a second palette of makeup, and a third carrier 226. For further details of the construction of the carriers, palettes, and how the carriers are joined together and folded and closed, and any other details, reference is made to the description above.

Further, similar to system 110, makeup system 210 also includes a mirror 220 in lieu of support 20. Mirror 220 may be surface mounted to carrier 226 or may be mounted in a pocket formed in or on carrier 226. For further details, reference is made to makeup system 110. In addition, in the illustrated embodiment carrier 226 include a support for the mirror so that the mirror can remain in an upwardly tilted position. For example, the support may be formed by a fourth panel 226*a* that is hinged to the upper edge of carrier 226 so that it may be either folded over the mirror when makeup system 210 is folded when not in use or folded behind carrier 226 (and behind mirror 220) and tilted to provide support to carrier 226. Panel 226*a*, therefore, forms a kick stand for the mirror.

Figure 7:
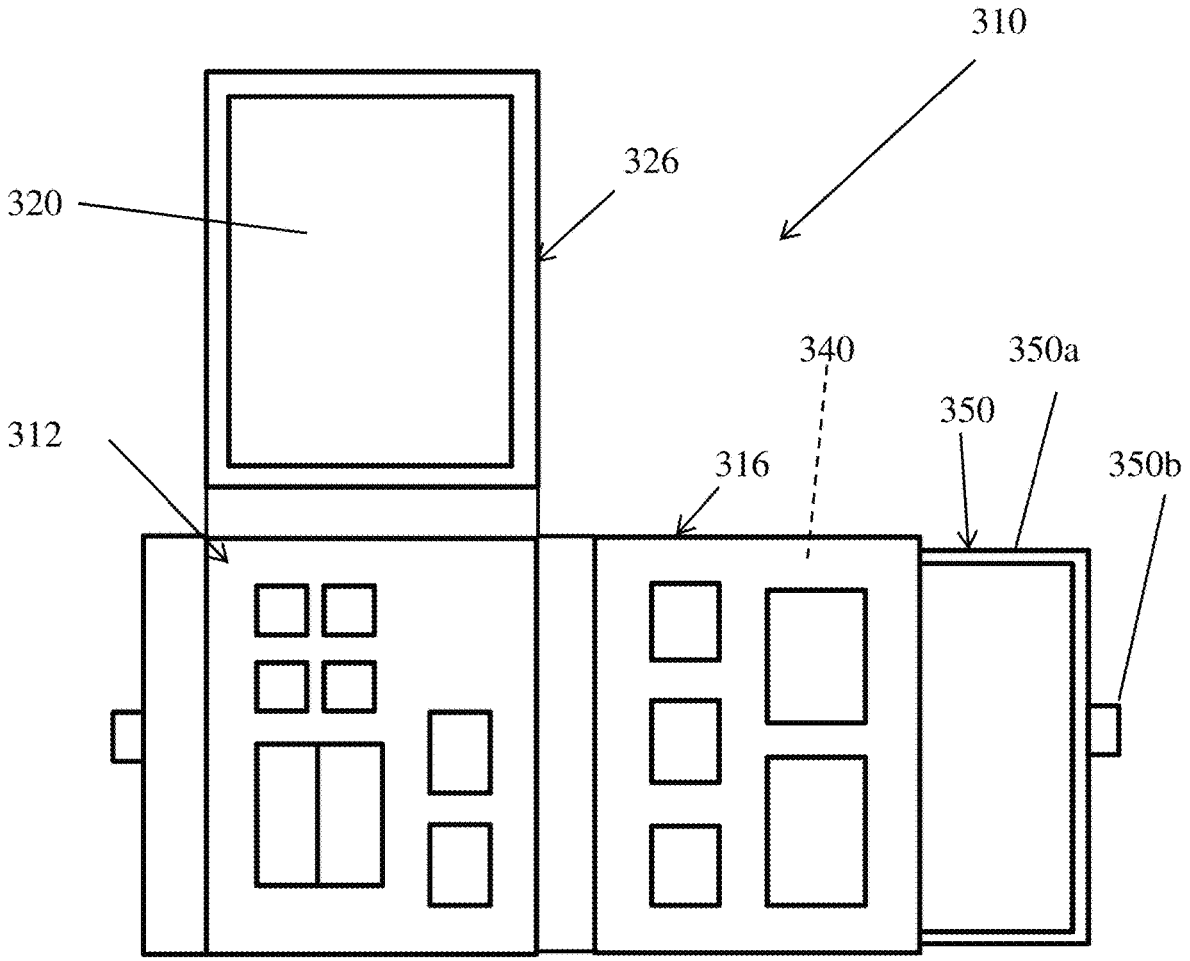
FIG. 7 perspective view of a third embodiment of a makeup system.

In another embodiment, one of the carriers may have a receptacle formed in the panel or between the panels that form the carrier, which receptacle extends and is open along one edge of the carrier and which may be used to house a mirror or additional cards or a tray. Referring to FIG. 7, the numeral 310 designates another embodiment of the makeup system. Similar to makeup systems 10, 110, and 210, makeup system 310 includes a first carrier 312 which supports first palette of makeup, a second carrier 316 for holding a second palette of makeup, and a third carrier 326. For further details of the construction of the carriers, palettes, and how the carriers are joined together and folded and closed, and any other details, reference is made to the description above.

Further, makeup system 310 also includes a mirror 320 in lieu of support 20. Mirror 320 may be surface mounted to carrier 326 or may be mounted in a pocket formed in or on carrier 326. For further details, reference is made to makeup system 110.

In the illustrated embodiment, carrier 316 may include a receptacle 340 for holding a tray 350. As noted above, each carrier may be formed from two panels, with the receptacle formed there between. For example, the two panels may have spacers, in the form of narrow strips of cardboard or plastic strips there between, which maintain the two panels in a spaced relationship and thereby form receptacle 340.

Referring again to FIG. 7, the tray 350 may have a lip 350*a* that extends around the perimeter of the tray (and thereby form a drawer) to help retain small items on the tray when the tray is opened. Additionally, tray 350 may include a pull 350*b* to help a user grab and pull the tray to an open position (such as shown in FIG. 7). As would be understood, tray 350, therefore, allows a user to store other makeup, makeup tools or applicators or other items.

The makeup systems described herein may provide a system of managing cosmetics by allowing a user to select which makeup pans they wish to have mounted to the carriers and replace them with other colors as desired. Therefore, each carrier can be customized to a particular user's personal preferences. Further, the guides may be replaced and substituted with a guide that applies to the selected makeup scheme.

Accordingly, the makeup system may provide a compact, portable makeup system, which is strategically organized into a step-by-step makeup system. The number and size of the makeup pans and the type of makeup they hold, e.g. powder or cream, may be selected based on the user's preference. As a result, everything a user needs may be provided in one place. No more shuffling through a bag of products or fussing with compacts. This can therefore allow a user to streamline their routine and cut down on prep time by eliminating the opening and closing of multiple products. No more searching through a pile of products to find your everyday shades. No more wasting money on elaborate palettes where you only end up using a few of the colors.

While several forms of the inventions have been shown and described, the above description is that of current embodiments of the invention. It should be understood that one or more features from one embodiment may be combined with one or more features of another embodiment or embodiments. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert but which can be used independently and/or combined with other features. The present invention is not limited to only those embodiments that include all of these features or that provide all of the stated benefits, except to the extent otherwise expressly set forth in the issued claims. For example, any reference to claim elements in the singular, for example, using the articles "a," "an," "the" or "said," is not to be construed as limiting the element to the singular. Additionally, directional terms used in the specification, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

We claim:

1. A makeup system comprising:

a foldable assembly having an inside and a thickness when folded, said foldable assembly comprising:

a first carrier having a thickness, a height, a length, a top edge, a first side edge, and a second side edge opposed from the first side edge with the length extending between the first side edge and the second side edge;

a second carrier having a thickness, a height, a length, a side edge, the first side edge of the first carrier being joined with the side edge of the second carrier with a living hinge and joined in a manner to allow each of the first and second carriers to be folded together to a closed storage position and unfolded to an open, in-use position to allow access to the inside of the foldable assembly;

the first carrier being formed by a first pair of spaced planar panels, each panel of said first pair of spaced planar panels comprising a paper-based material, said first pair of spaced planar panels forming a first exterior side and a second exterior side of said first carrier, said first exterior side of said first carrier forming a first planar surface, said second exterior side of said first carrier forming a second planar surface;

the second carrier being formed by a second pair of spaced planar panels, each panel of said second pair of spaced planar panels comprising a paper-based material, said second pair of spaced planar panels forming a first exterior side and a second exterior side of said second carrier, said first exterior side of said second carrier forming a third planar surface, and said second exterior side of said second carrier forming a fourth planar surface;

the second exterior sides of the first and second carriers forming exterior surfaces of the foldable assembly when said first and second carriers are folded in their closed storage positions, and the first exterior sides of the first and second carriers forming interior surfaces of the foldable assembly when the first and second carriers are folded in their closed storage positions;

each of the first and third planar surfaces of the first and second carriers having a plurality of spaced apart recesses formed therein, wherein said recesses form a first group of recesses, a second group of recesses, and a third group of recesses;

each of the plurality of spaced apart recesses having a makeup pan therein, each makeup pan having makeup therein to form first and second makeup palettes in the first and second carriers, respectively, with said first and second makeup palettes being accessible when the first and second carriers are in said open, in-use position, the makeup in the first group of recesses comprising a first makeup, the makeup in the second group of recesses comprising a second makeup, and the makeup in the third group of recess comprising a third makeup, wherein the first makeup is different than the second makeup and the third makeup, and the second makeup is different than the third makeup, the first planar surface of the first carrier surrounding each recess of the plurality of spaced apart recesses in the first carrier, and the third planar surface of the second carrier surrounding each recess of the plurality of spaced apart recesses in the second carrier;

a third carrier having a thickness, a height and a length, said third carrier comprising a paper-based material having a first side with a fifth planar surface and a second side with a sixth planar surface and having a lower edge joined with the top edge of the first carrier by a living hinge in a manner to allow the third carrier to be folded against the first carrier to a closed position between the first carrier and the second carrier, the first side of the third carrier forming an exterior surface of the foldable assembly when the third carrier is unfolded, and the first and second sides of the third carrier forming interior surfaces of the foldable assembly when the first, second, and third carriers are folded together in their closed positions, wherein when folded the first planar surface of the first carrier contacts the fifth planar surface of the third carrier with the contact there between extending around the respective makeup pans of the first carrier and extending across the length and the height of each of the first and third carriers and wherein the third planar surface of the second carrier contacts the sixth planar surface of the third carrier with the contact there between extending around the respective makeup pans of the second carrier and extending across the length and the height of each of the second and third carriers such that the thickness of the foldable assembly approximately equals to the total of the thicknesses of the first, second and third carriers and wherein the first, second and third carriers have a flat stacked adjacent arrangement when folded wherein each carrier does not extend into it respective adjacent carrier, and wherein each of the first, second and third carriers has an outer perimeter forming a footprint, the footprints of the first, second and third carriers being substantially equal wherein the outer perimeters of the first, second and third carriers are generally aligned when the first, second and third carriers are in their closed positions to form at least a portion of the outer perimeter of the foldable assembly;

wherein one carrier of the first and second carriers includes a closure mechanism for securing the first, second, and third carriers together when folded together in their closed positions, and the closure mechanism comprising a flange and a living hinge joining the flange with the one carrier; and a support joined with the third carrier by a living hinge to support the third carrier in an open position when the first and second carriers are unfolded and supported on a planar support surface in said open in use positions wherein a user can view the third carrier while having access to the makeup pans.

2. The makeup system according to claim 1, wherein the pair of spaced planar panels of said first carrier and the second carrier each comprise a first panel and a second panel, said first panels forming the first and third planar surfaces of the first and second carriers, respectively, and the second panels of said first carrier and the second carrier being joined by the living hinge.

3. The makeup system according to claim 1, wherein the second side of the third carrier includes a pocket for supporting an information sheet.

4. The makeup system according to claim 3, wherein the third carrier includes the pocket, and the second side of the third carrier includes a transparent sheet of material forming the pocket for supporting the information sheet.

5. The makeup system according to claim 4, further comprising an information sheet, the information sheet including a guide on how to apply the makeup in the first makeup palette and/or the second makeup palette in the makeup system.

6. The makeup system according to claim 1, wherein the third carrier includes a mirrored surface.

7. The makeup system according to claim 1, wherein each carrier is formed with a cover, the cover forming the living hinges.

8. The makeup system according to claim 1, wherein the thickness of the first carrier is same as the thickness of the second carriers wherein when opened, the planar surfaces of the second side of the first and second carriers may have a generally coplanar arrangement.

9. The makeup system according to claim 1, wherein the foldable assembly has a side with a length, the flange being mounted to extend along the side of said foldable assembly and having a height generally equal to the total thickness of the first, second, and third carriers when in their closed positions and having a length equal to the length of the side of the foldable assembly wherein when closed the flange extends over the edges of the first, second, and third carriers at the side of the foldable assembly and forms an outer surface of the foldable assembly at the side of the foldable assembly.

10. The makeup system according to claim 9, wherein the closure mechanism is mounted to the first carrier and further includes a flap extending from the flange for folding over the exterior side of the second carrier when the first, second, and third carriers are in their closed positions, and the flap including a releasable fastener for securing the carriers in a folded configuration.

11. The makeup system according to claim 9, wherein the flange has a releasable fastener, the fastener comprising a magnet.

12. The makeup system according to claim 1, wherein the makeup pans are removable from the recesses.

* * * * *